United States Patent [19]

Clausin

[11] Patent Number: 4,573,424

[45] Date of Patent: Mar. 4, 1986

[54] SAIL SHORTENING ROLLER FOR SAILING BOATS

[75] Inventor: Pierre Clausin, Ville d'Avray, France

[73] Assignee: Proengin S.A., France

[21] Appl. No.: 569,636

[22] Filed: Jan. 10, 1984

[30] Foreign Application Priority Data

Jan. 13, 1983 [FR] France ..... 83 00593
Jun. 9, 1983 [FR] France ..... 83 09717
Nov. 25, 1983 [FR] France ..... 83 18985

[51] Int. Cl.[4] ..... B63H 9/10
[52] U.S. Cl. ..... 114/106; 403/298
[58] Field of Search ..... 114/104–107; 403/298, 292, 381, 310

[56] References Cited

U.S. PATENT DOCUMENTS 573,203 12/1896 Budke ..... 403/298
2,868,602 1/1959 Drezner ..... 403/298
3,948,200 4/1976 Hood et al. ..... 114/105
3,980,036 9/1976 Crall ..... 114/106
4,248,281 2/1981 Hood ..... 114/106

*Primary Examiner*—Sherman D. Basinger
*Attorney, Agent, or Firm*—William A. Drucker

[57] ABSTRACT

A sail shortening device for rolling up a sail on a tubular element mounted for rotation about a rigging cable of a sailing boat which comprises at least two tubular sections connected end to end for forming said tubular element, at least one shaped connecting element engaging in said tubular sections, two shaped end elements mounted at both ends of the tubular element and bearings housed respectively between said cable, said shaped connecting element and the two shaped end elements. The tubular element comprises at least one longitudinal groove in which the bolt rope can be introduced. The tubular element is held in axial direction and can be rotated by a drum. A swivel is slidably mounted on the tubular element and comprises means for fixing to a halyard for hoisting and tensioning the sail.

22 Claims, 27 Drawing Figures

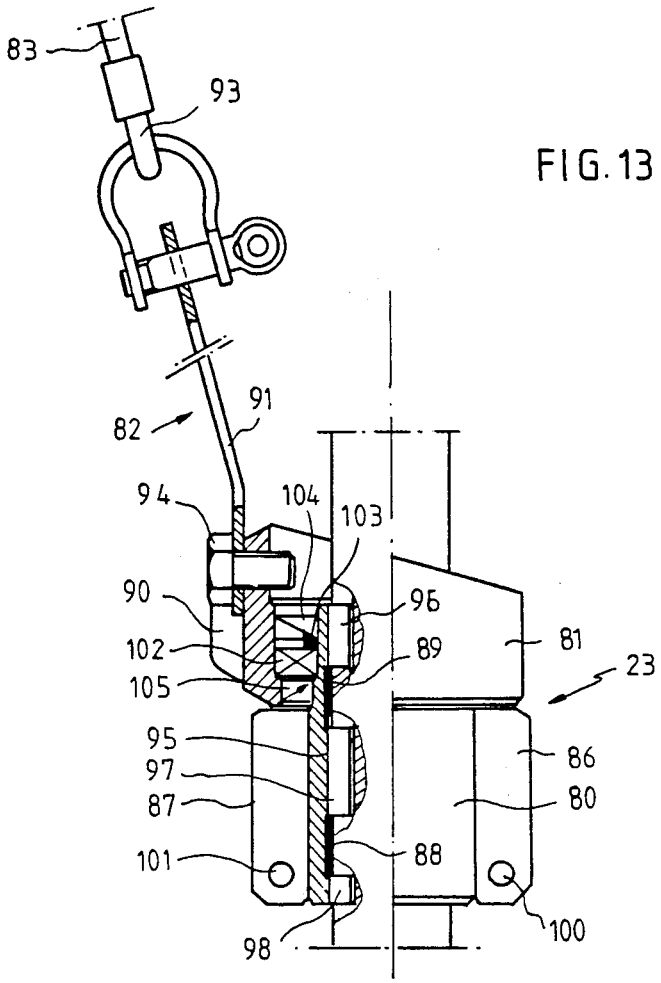
FIG. 13
FIG. 14
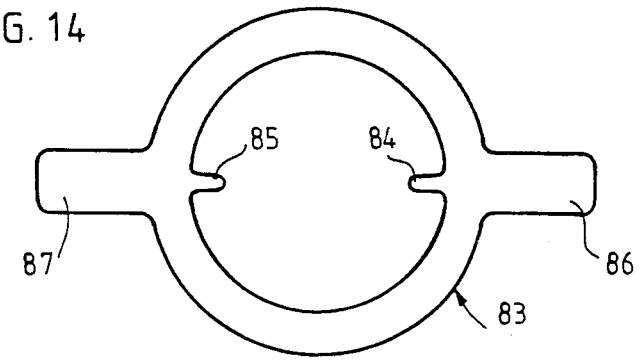

FIG. 24
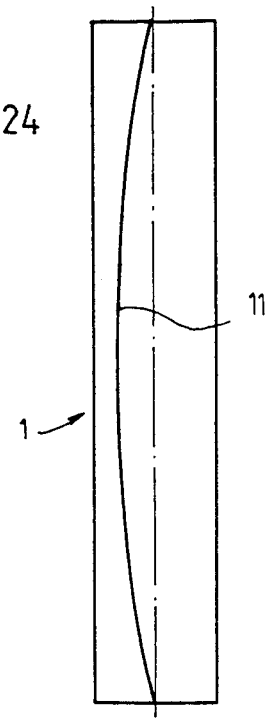
FIG. 25
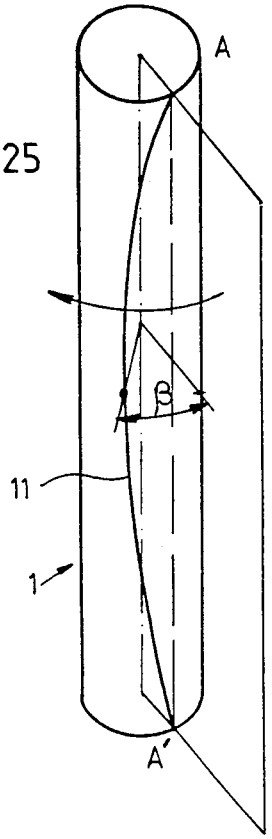
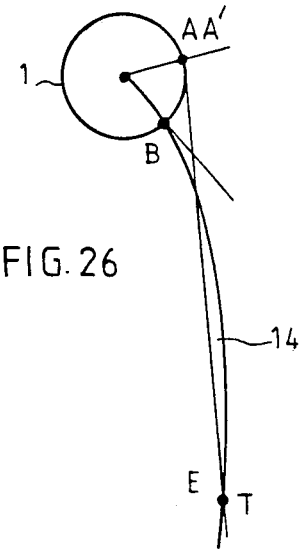
FIG. 26
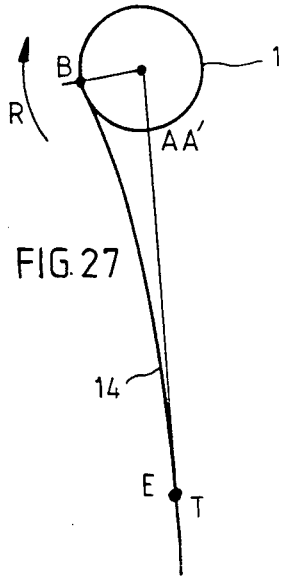
FIG. 27

SAIL SHORTENING ROLLER FOR SAILING BOATS

BACKGROUND OF THE INVENTION

1. Field of the Invention

The present inventon relates to a sail shortening roller for winding up a sail of a sailing boat on a tubular sheath mounted for rotation about a rigging cable, for example about the jib stay.

2. Description of the Prior Art

Generally, it is known that numerous devices of this kind have already been proposed, usually called jib or main sail roller reefers.

However, it has proved in use that these reefers do not allow all the expected results to be obtained, more especially for the following reasons:

They usually require for fitting a modification of the cable, generally a cut and a connection, because of the presence of the usual terminations of the cable such as crimped eyes, toggles or turnbuckles.

They are subject to defects in reefing the sail, this latter tending to form, during winding, folds or pockets due to slight axial displacements towards the middle of the sail along the tubular sheath during winding thereof or, quite simply, because of the shape of the sail (belly of the sail).

They comprise elements secured to the tubular sleeve or to the surroundings thereof which cause in the long run damage to the sail and which, when they are fitted by screwing or by riveting, considerably weaken the tubular element.

They do not allow good regularity of the rotational movement of the tubular element to be obtained particularly when reefing up of the sail takes place when the stay assumes camber under the effect of the wind or because of excessive play between the stay and said tubular element.

They often cause locking of the rotation of the tubular element about the cable following winding up of the halyard used for hoisting the sail or the handling rope which operates the reefer. The invention relates more particularly to a sail shortening device having high reliability and whose structure is especially designed so as to avoid the above-mentioned disadvantages and so as to further obtain numerous advantages which will be mentioned in the following description.

SUMMARY OF THE INVENTION

To this end, the sail shortening device of the invention comprises first of all the tubular element extending about the cable, over at least a part of its length and formed of coaxial tubular sections disposed end to end and fixed to each other by means of connecting elements fitted inside the tubular sections, on each side of each of the junctions. This tubular element is mounted for rotation on the cable by means of bearings inserted between the cable and the connecting elements. It is provided with at least one longitudinal groove forming, inside the tubular element, a longitudinal cavity whose section is at least equal to the section of the bolt rope and a longitudinal opening. This opening, in the lower part of the tubular element, has a width at least equal to the diameter of the bolt rope and, in the rest of the tubular element, a width less than the diameter of the bolt rope, but greater than the thickness of the sail. Thus, the bolt rope may be introduced into the cavity of the longitudinal groove through the widened opening of the lower part of the tubular element, then be engaged by sliding in the part of the groove which has an orifice of smaller width.

The tubular element is held axially in position, in its lower part, by means of a rotary connection comprising means for securing to a fixed part of the boat. It may be rotated by drive means also mounted in the lower part of the tubular element, these drive means consisting, for example, of a drum about which a rope may be wound.

Furthermore, the sail shortening device comprises a swivel slidably mounted on the tubular element for hoisting and tightening the sail. To this end, this swivel comprises means for fixing it to a lifting device, for example to a halyard passing over a pulley (sheave) mounted at the mast head.

BRIEF DESCRIPTION OF THE DRAWINGS

Other features and advantages of the invention will be clear from the embodiments described hereafter, by way of non limiting examples, with reference to the accompanying drawings in which:

FIG. 13 is a side view, partially in section, of a swivel;

FIG. 14 is a cross section of the shaped piece from which is formed the inner sleeve of the swivel shown in FIG. 13 and of the device for holding the tubular element in the axial position;

FIGS. 24 and 25 are schematical views, a developed view (FIG. 24) and a perspective view (FIG. 25) for illustrating the curvature which the groove of the tubular element may have for varying the belly of the sail and avoiding the formation of pockets and/or folds on reefing;

FIGS. 26 and 27 are cross sections illustrating the effect produced on the reefing of the sail, because of the curvature of the groove shown in FIGS. 24 and 25.

DESCRIPTION OF THE PREFERRED EMBODIMENTS

Figure 1:
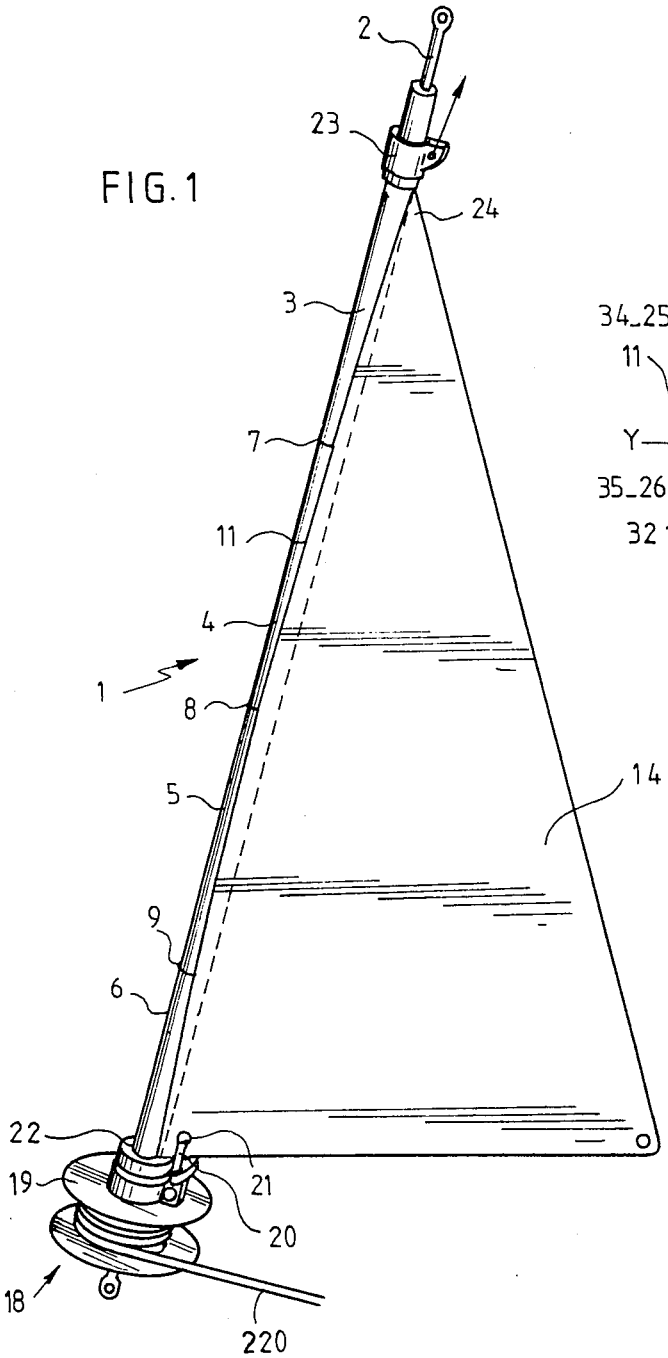
FIG. 1 shows, in schematical perspective, a sail shortening device mounted on a jib stay of a boat.

In the way indicated previously, the sail shortening device shown in FIG. 1 is formed first of all of a tubular element 1 extending about a stay 2 of the rigging of the boat, only the ends of which are shown. This tubular element 1 is formed from several coaxial tubular sections 3, 4, 5 and 6 disposed end to end and fixed to each other by means of connecting elements fitting inside the sections, on each side of the junctions 7, 8 and 9.

Figure 2:
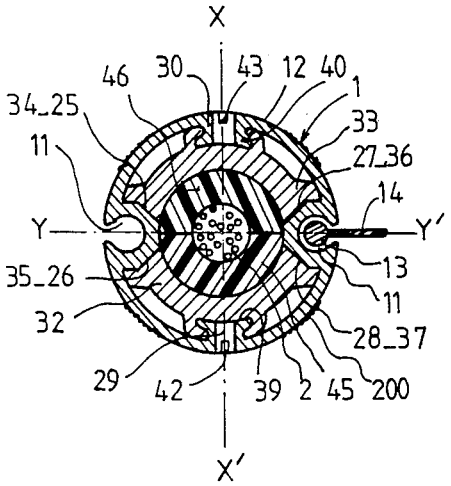
FIG. 2 is a schematical cross section for illustrating a first method of connecting the tubular sections together forming the tubular element about which the sail is wound as well as the rotary mounting of this tubular element on the stay.
Figure 3:
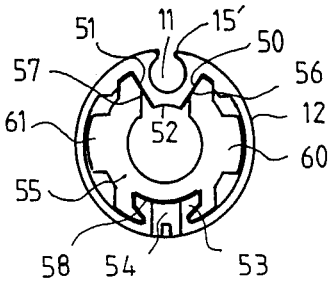
FIG. 3 is a sectional view for illustrating a second method of connecting together the tubular sections forming the tubular element.

This tubular element 1 comprises, as shown in FIGS. 2 and 3, at least one longitudinal groove 11 extending over the whole of its length and opening out into its outer surface 12. This longitudinal groove 11, for slidingly receiving the bolt rope 13 of sail 14, has, in the example shown, a circular section with a diameter substantially equal to that of the bolt rope 13. In the lower part of the tubular element 1, this groove 11 has, at least in a given zone, an opening 15 at least equal to the diameter of the bolt rope 13, for allowing introduction thereof. In the rest of the tubular element 1, the width of this opening 15' is less than the diameter of the bolt rope 13, while being a least equal to the thickness of the sail 14, so that the bolt rope 13 may slide axially in groove 11, the sail 14 passing through opening 15' and is firmly retained therein in the radial direction.

The tubular element 1 further comprises, in its lower part, an axial holding device 17 securable to a fixed part of the boat as well as a drum 18 for rotation thereof and whose upper flange 19 is equipped with a shackle 20 for fixing the tack 21 of the sail 14.

On the tubular element 1 are slideably mounted a bolt rope guide 22 as well as a swivel 23 to which is fixed the head 24 of sail 14 and which may be driven longitudinally by a halliard passed over a pulley abutting the mast.

In the example shown in FIG. 2, the tubular sections 3, 4, 5, 6 forming the tubular element 1 are formed from shaped tubes circular in section having, in two diametrically opposite positions, two longitudinal grooves 11 circular in section opening outwardly and forming, inside the tubular section, two longitudinal bosses with oblique sides 25, 26 27, 28. The internal surface of the sections further comprises, perpendicularly to the plane passing through the two grooves 11 and projecting inwardly, two internal diametrically opposite ribs 29, 30 which each have in section a dove-tail shape.

In this example, the means for joining the tubular sections together consist of two identical-shaped connecting pieces 32, 33 substantially semi-cylindrical in shape each comprising two oblique longitudinal edges 34, 35, 36 37 coming into contact with the oblique sides 25, 26, 27, 28 of the longitudinal bosses and, on its external face, a longitudinal concavity 39, 40 having a dove-tail shape in section and dimensions similar to those of the dove-tail shape of the internal ribs 29, 30 of the tubular section. Thus, on assembly, the two shaped connecting pieces 32, 33 are engaged by sliding in two adjacent tubular sections, the two dove-tail shapes 29,30–39,40 being engaged one in the other and the oblique edges 34, 35, 36, 37 coming into contact with the corresponding oblique sides 25, 26, 27,28 of the tubular sections.

Fixing is then achieved by means of clamping screws 42, 43 screwed into radial bores formed in the tubular sections at the level of the dove-tail ribs 29,30. Because of the pressure exerted by screws 42, 43 on the shaped connecting pieces 32, 33 which is retransmitted to the oblique sides 25, 26, 27, 28 of the bosses through the oblique edges 34, 35, 36, 37, this arrangement has the advantage of ensuring automatic take up of the coupling play inherent in the manufacturing tolerances of the shaped pieces. Screws 42, 43 further couple the tubular sections as far as translational movements are concerned.

As can be seen in FIG. 2, the oblique sides 25, 26, 27, 28 (or steps) of the bosses have a substantially V shape, which limits the movement of the shaped connecting pieces 32, 33 towards the axis thus allowing, by strict coupling of the inner sufaces of the shaped connecting pieces 32, 33 and of the bosses, a perfectly cylindrical inner volume to be obtained. Furthermore, the movement of the shaped connecting pieces 32, 33 by screws 42, 43 is limited to the clearance provided in the dove-tail assembly 29, 30–39, 40. This play is provided so that the edges 34, 35, 36, 37 of the shaped connecting pieces 32, 33 and the corresponding sides 25, 26, 27, 28 of the bosses come into contact before locking of screws 42, 43. This arrangement thus avoids ovalization of the tubular sections 3, 4, 5, 6 during tightening of screws 42, 43.

A particularly advantageous characteristic of the invention concerns the layout of the dove-tail shaped internal ribs 29, 30 of the tubular sections in which are situated the tappings of the holes for screws 42, 43 and the layout of the oblique sides 25, 26, 27, 28 of the bosses. Thus, the layout of these parts may be advantageously formed so that the moments of inertia along axes X X' and Y Y' are identical so that bending of the tubular element 1 is uniform about its axis. This characteristic has the advantage of avoiding irregularities in the rotational movement of the tubular element 1 when reefing of sail 14 takes place when stay 2 assumes a camber following the effect of the wind.

In the example shown in FIG. 2, the rotational guiding of the tubular element 1 on stay 2 is provided at the level of the couplings. This rotational guiding is provided by cylindrical bearing bushes made in two parts 45, 46 which are housed in the cylindrical volume formed, on the one hand, by the internal surfaces of the two shaped connecting pieces 32, 33 and, on the other hand, by the ends of the longitudinal bosses of the tubular sections. These bearing bushes 45 and 46 are formed by two parts molded from plastic material. Securing thereof during translational movement is obtained by end flanges.

In the example shown in FIG. 3, the tubular element only comprises one groove 11 opening outwardly and whose walls form, inside the tubular sections, a longitudinal boss substantially trapezoidal in section which comprises, consequently, two oblique sides 50, 51 and a small base 52, having a coaxial cylindrical surface. On a longitudinal zone of the inner surface of the tubular sections, diametrically opposite groove 11, is provided a projecting rib 53 in the form of a dove-tail, through which are formed the radial tapped bores into which the clamping screws 54 may be screwed.

In this case, the connection between each pair of tubular sections is provided by means of a single connecting shaped piece 55, having the shape of a C in section, whose opening allows introduction of the stay, once this latter has been passed into the tubular sections. This opening is defined by two oblique edges 56, 57 intended to come into contact with the oblique sides 50, 51 of the longitudinal boss when the shaped connecting section 55 is engaged in a corresponding section.

Of course, the assembly of two adjacent tubular sections is obtained by causing the shaped connecting piece 55 to penetrate also into the two tubular sections, on each side of the junction. Consequently, penetration of the shaped piece 55 inside one of the two tubular sections is limited to a half length by stops, not shown, projecting inside said section. Moreover, the shaped connecting section 55 comprises, on its outer face, a longitudinal cavity 58 having a dove-tail shape in section, diametrically opposite its opening, and in which, during assembly, the rib 53 of the tubular section is engaged.

Once the two sections are assembled by means of the shaped connecting piece 55, locking is obtained by screwing screws 54 into the tapped bores. These screws 54 exert, on the shaped connecting piece 55, a pressure orientated in the bisecting plane of the oblique sides 56, 57 of the shaped connecting piece 55 and of the oblique sides 50, 51 of the boss of the tubular section. Thus, under the effect of this pressure, the oblique sides 56, 57 of the shaped connecting piece 55 come firmly into abutment against the corresponding oblique sides 50, 51 while taking up the play. In a similar way to the preceding one, the taking up of the play is limited to the play existing between the two dove tail shapes 53, 58. Moreover, the shaped connecting piece 55 comprises on each side between its opening and the dove tail shaped cavity 58, two external strengthening portions 60, 61 with cylindrical surface bearing on the inner cylindrical surface of the tubular section. These strengthening portions 60, 61 thus avoid deformation of the tubular element 1 at the level of the couplings when it is subjected to a high twisting torque.

Figure 4:
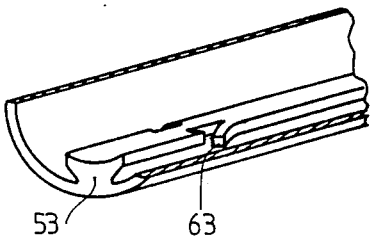
FIG. 4 is a partiel perspective view showing the shape of the inner surface of a tubular section.

In the example shown in FIG. 4, penetration of the shaped connecting piece 55 inside the tubular sections is limited by means of stops 63 formed by cutting out lips in the dove tail shaped rib 53 then by bending the cut out part.

Figure 5:
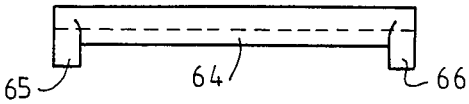
FIG. 5 is a side view of a half bearing for mounting in the connecting element equipping the tubular section shown in FIG. 4.

The rotary mounting of the tubular element obtained by the assembly of sections in the way described in FIG. 3 is provided at the level of each of the junctions, by means of a cylindrical bearing formed in two parts 64 one of which is shown in FIG. 5. These two bearing parts 64 are fitted inside the shaped connecting piece 55 and comprise flanges 65, 66 for securing same against axial movement inside said shaped piece 55.

Figure 6:
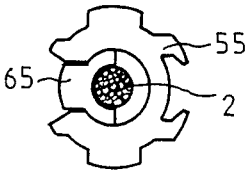
FIGS. 6 to 9 are schematical views illustrating the principle of fitting the two half bearings in the connection element used in FIG. 4.
Figure 7:
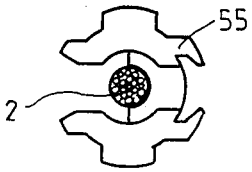
Figure 8:
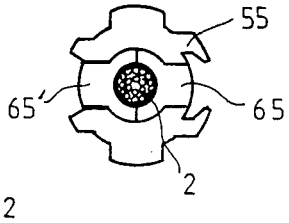
Figure 9:
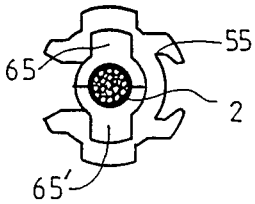

The width of flanges 65, 66 is provided less than the opening of the shaped cutting piece 55, so as to allow assembly of the type shown in FIGS. 6 to 9. In this assembly, after the stay has been placed in the shaped connecting piece 55, the first bearing part 64 is fitted by sliding it parallel to the axis so that the flanges 65, 66 are orientated towards the opening of the shaped piece 55 and allow introduction thereof (FIG. 6). This first bearing part 65 is then rotated in place through an angle of 180° so as to position it opposite the opening (FIG. 7). The second bearing part 65' is then fitted like the preceding one (FIG. 8) then the assembly formed by the two parts 65, 65' is rotated in place through an angle of 90° so as to reach the final position shown in FIG. 9.

In the sail shortening or reefing device previously described, the bearings which rotatably guide the ends of the tubular element 1 on stay 2 are held in place by means of shaped end pieces 70 similar to the shaped connecting pieces already described, these shaped end pieces 70 then being engaged wholly in the corresponding tubular section and being secured against movement by a locking element fixed by a screw 71, which may be a self tapping screw, screwed at the end of the longitudinal groove 11 in the tubular element 1.

Figure 10:
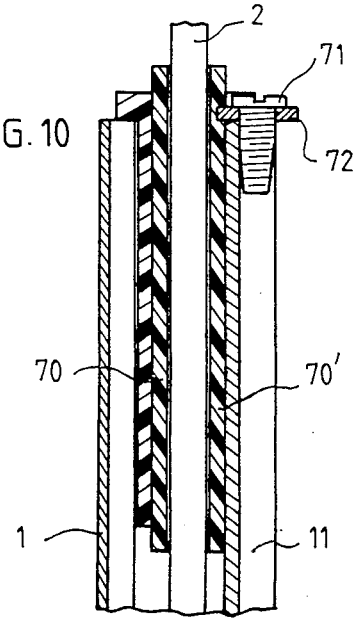
FIGS. 10 and 11 are axial (FIG. 10) and cross (FIG. 9) sections illustrating a method for mounting the endmost bearings of the tubular element.
Figure 11:
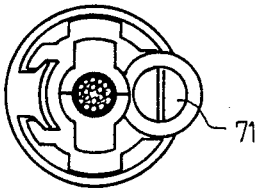
Figure 12:
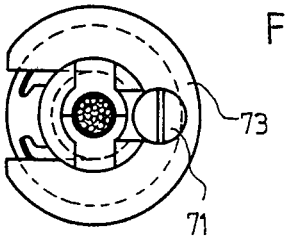
FIG. 12 is a top view illustrating another method of fixing said endmost bearings.

In the example shown in FIGS. 10, 11 and 12 the end of the tubular element is provided with a shaped end piece 70 of the type of the shaped connecting piece 55 shown in FIGS. 3 and 6 to 9. Similarly, this shaped end piece 70 houses a two part bearing 70', each part being similar to that shown in FIG. 5. In the example shown in FIGS. 10 and 11, the locking element is formed by a washer 72 which penetrates into a groove formed in the shaped end piece 70 and fixed to the tubular element by means of a screw 71.

Of course, the invention is not limited to this arrangement alone: the locking element, as shown in FIG. 12, could very well comprise a C-shaped part 73 which penetrates into the circular groove machined in the shaped end piece 70 and fixed to the tubular element 1 by means of a screw 71 engaged in the longitudinal groove 11. It will be noted that this C-shaped part 73 may further serve as swivel stop.

As mentioned above, the sail shortening or reefer device of the invention uses a swivel 23 mounted for sliding along the tubular element 1 and intended for hoisting and tensioning the sail 14 by means of a halliard passed over a pulley adjoining the mast. This swivel 23 comprises then an inner tubular sleeve 80 which slides along the tubular element 1 and which is rotated by this latter. This tubular sleeve 80 further comprises means for fixing the head 24 of the sail 14 and supports an outer tubular sleeve 81, free to rotate but secured against axial movement, which comprises means 82 for fixing to the halliard 83.

In a particularly advantageous embodiment of the invention, shown in FIG. 14, the inner sleeve 80 sliding on the tubular element 1 is formed from an extruded cylindrical-shaped part comprising, in the case of a tubular element 1 with two grooves 11, two inner projections 84, 85 for engagement in said grooves 11, so as to provide the rotational drive and two projecting external ribs 86, 87 forming lugs to which the head 24 of sail 14 may be mounted. The extruded shaped part 83 is machined, after cutting to the desired width, by turning then boring. It receives on the inside one or more bushes 88, 89 made from a plastic material for isolating it from the tubular element 1 on which it slides. These bushes 88, 89 may be advantageously held in position inside the inner sleeve by the remaining portions, after machining of the inner projections 84 and 85.

A similar manufacturing process may be used for obtaining the outer sleeve 81, which will then comprise ribs 90 for laterally holding the fixing device 82 for halliard 83. Preferably, the device 82 for fixing the halliard 83 comprises a connecting element 91 adjustable in length between the swivel 93 and the halliard 83 and intended, when sail 14 is tensioned, to bring the eye 93 of halliard 83 as close as possible to the mast head sheave so as to avoid wrapping of the halliard 83 about stay 2 should there be insufficient tension in this latter.

In another particularly advantageous embodiment of the invention, this connecting element 91 is formed by a punched steel strip fixed to swivel 23 by means of a screw 94. Thus, the choice of the hole in the strip at the level of which fixing is to be provided allows its length to be adjusted to the distance which separates swivel 23 from the mast head sheave, this distance varying depending on the boats.

In the example shown in FIG. 13, the swivel comprises an inner sleeve 80 machined as described above. The inner cylindrical surface 95 of this sleeve 80 comprises two machined grooves in which are placed the bearings 88, 89. The rotational drive for the inner sleeve is provided by inner projecting portions 96, 97, 98.

The outer surface of this inner sleeve 80 comprises, in addition to the outer ribs 86, 87 provided with holes 100, 101 for fixing the head 24 of sail 14, a cylindrical part on which the outer sleeve 81 is mounted for rotation, by means of a ball bearing 102 secured by a circlip 103 and housed in a sealed cavity filled with grease, closed by lip seals 104 and 105. This outer sleeve comprises on the outside two longitudinal ribs 90 for laterally holding in position a punched steel strip 94 serving for securing the halliard 83.

Figure 15:
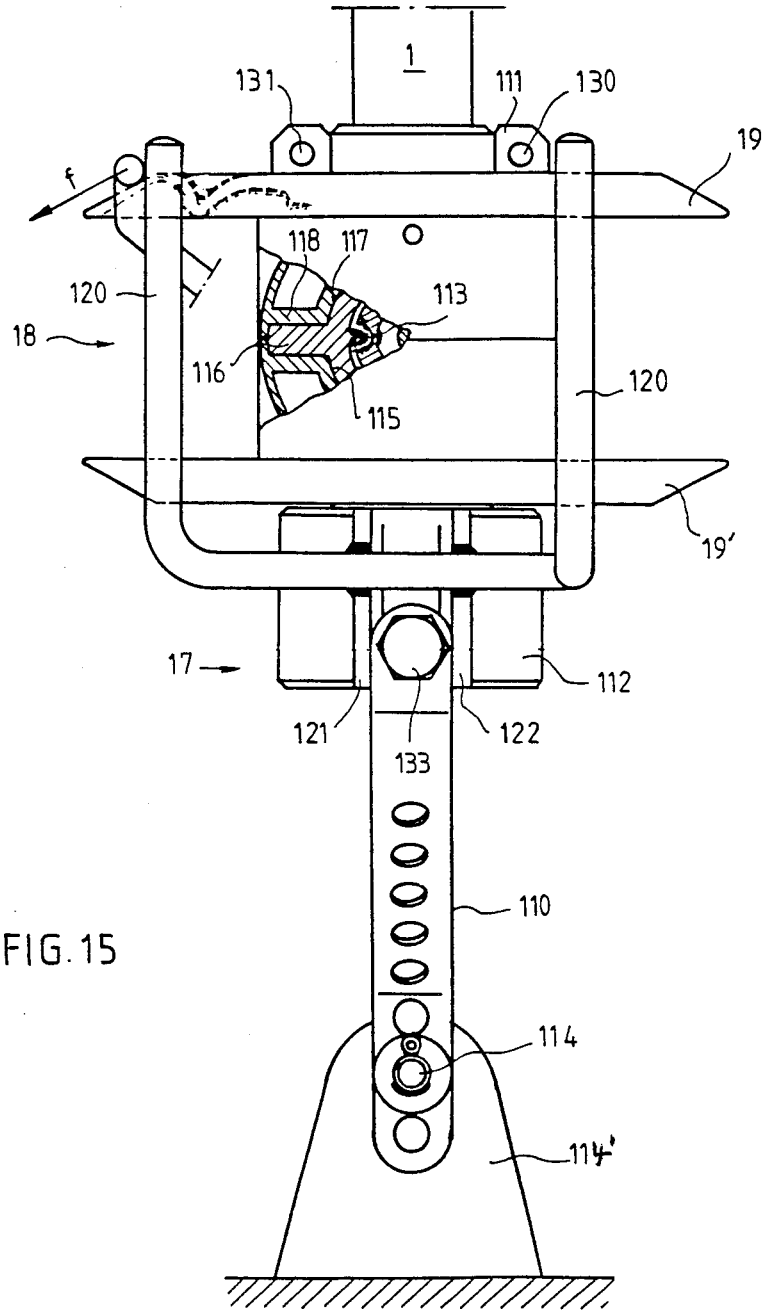
FIG. 15 is a side view of the lower part of the tubular element onto which are mounted a drum for rotational drive associated with a device for holding the tubular element in the axial position.

As mentioned above, the tubular element 1 is equipped, at its lower part, with an axial holding device 17 and rotational drive means 18. The device for axially holding the tubular element is more particularly intended to withstand the forces due to tensioning of the sail 14. It is joined, by a securing means 110, to the stay chain plate or to the usual connections adjoining this latter, such as turnbuckle, hinged coupling etc. This device 17 must hold the tubular element 1 axially while allowing rotation thereof. This latter mechanical junction, similar to that of swivel 23, leads, according to an advantageous feature of the invention, to an embodiment identical to this latter. In this case, the device for holding the tubular element axially may comprise, as shown in FIG. 15, an inner sleeve 111 mounted on the lower part of the tubular element and an outer sleeve 112 mounted for rotation on the inner sleeve 111 by means of a rotary mounting (bearing, seals, etc . . . ) similar to the one used for the swivel 23. These two sleeves 111, 112 may be advantageously obtained from the same shaped tubular piece as those for forming the sleeves of the swivel 23.

In this holding device, the inner sleeve 111 on which is fixed the tack point 21 of sail 14 rotates the tubular element 1 through inner projections 113 which penetrate into the groove or grooves 11 of the tubular element 1. This latter may be secured against longitudinal movement by any known means such, for example, as a screw.

The outer sleeve 112 comprises a means for fixing with the stay chain plate 114' of the boat. In the example shown, these means consist of two punched steel plates 110 one end of which is fixed for example by screwing to the outer face of the outer sleeve 112. With these punched steel plates 110, by the choice of the holes into which is introduced a fixing pin 114 which passes through the end of the stay cable and the connection to the chain plate 113, the desired position of the low part of the reefer may be more especially determined with respect to the deck.

The inner sleeve further comprises, beyond the outer sleeve, a cylindrical part 115 having two external radial wings 116, onto which is fitted a drum 18 which comprises for this purpose a central coaxial bore 117 as well as grooves 118 in which said wings 116 are engaged, so that this drum 18 is locked for rotation with the inner sleeve 111 and, consequently, with the tubular element 1. Furthermore, the wings 116 are provided externally with holes 130, 131 for hauling the jib or jibs.

Around this drum is wound a handling rope 220 held by four rods 120 parallel to the axis of rotation and close to the periphery of the flanges. These rods are formed by bending then welding bars to the ribs 121, 122 of the outer sleeve 112 of the holding device 17 and serve for holding the punched steel plates 110 laterally. These latter are fixed to the outer sleeve 112 by means of a screw 133.

According to a particularly advantageous feature of the invention, the outer edges of flanges 19, 19' of the drum are conical so that the portions of turns, which may accidentally come off the drum 18, between the holding rods 120, are brought back into the drum 18 as soon as a pull is exerted during reefing. In fact, the pull exerted for roller reefing the jib causes with the conical shape a force f which causes the rope to slide on the edge of drum 18 and brings it back towards the inside. Furthermore, the flanges of the drum 19, 19' may comprise coaxial circular undulations for providing a better arrangement of the turns of the rope inside the drum 18 and thus to avoid jamming.

The invention is not limited to the previously-described method for fixing the four parallel rods 120. In fact, these parallel rods 120 which serve for holding the rope in the drum may be removably mounted on the outer sleeve 112 so that they may be changed rapidly in the case of accidental damage.

Figure 16:
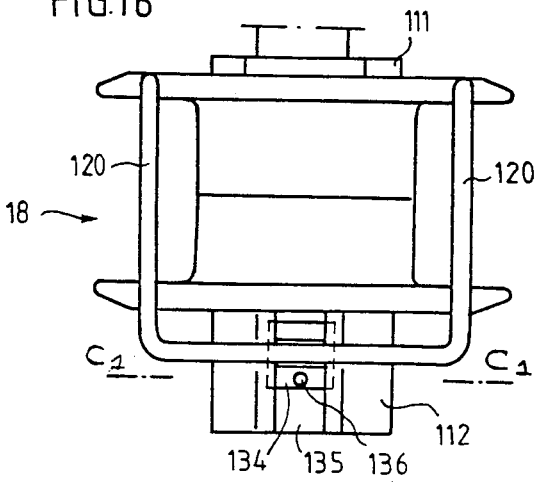
FIG. 16 is a side view similar to that of FIG. 15, but using a different method of mounting the guide rods for the rope which is wound in the drum.
Figure 17:
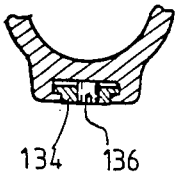
FIG. 17 is a partial section along $C_1$-$C_1$ of the FIG. 14, this section illustrating the method of fixing the rods for guiding the rope.

Thus, in the example shown in FIGS. 16 and 17, the two parallel rods 21 are formed by bending a bar then they are welded to a slider 134 which is placed in a T-shaped groove 135 in the inner sleeve 112 as shown in the partial section of FIG. 17. A screw 136 provides positional locking after mounting.

Figure 18:
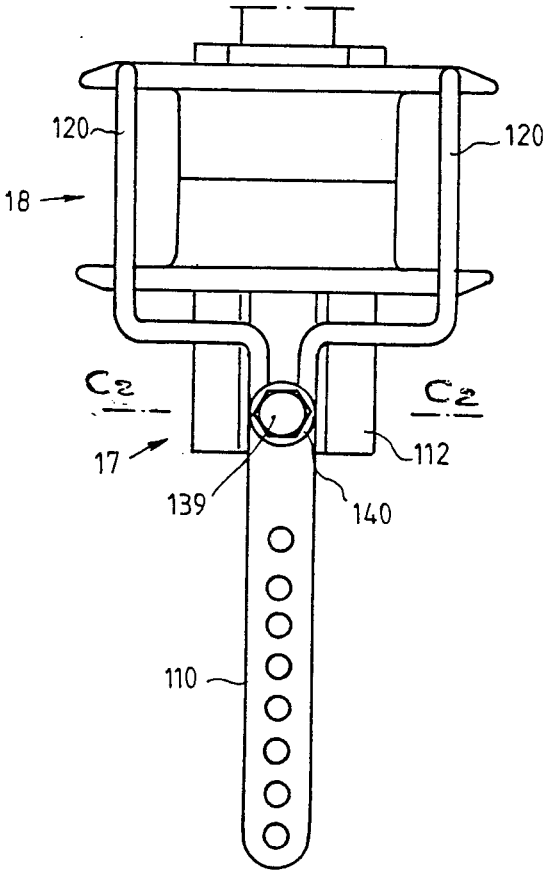
FIG. 18 is a side view similar to that of FIG. 16 illustrating another method of mounting the guide rods.
Figure 19:
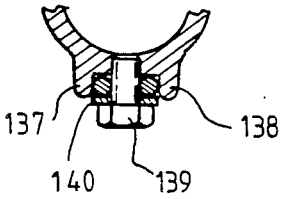
FIG. 19 is a seciton along $C_2$-$C_2$ of FIG. 18.

In the example shown in FIGS. 18 and 19, the parallel rods 120 are formed by bending a bar, so that the central part forms a U whose legs are guided by ribs 137 and 138 provided on the outer sleeve 112 as shown in the partial section of FIG. 19. These rods 120 are secured by a screw 139 and a bearing washer 140, this screw 139 further serving for fixing the punched steel strip 140 which, by being secured to a fixed part of the boat, holds the tubular element 1 axially.

As previously mentioned, the sail shortening or reefer device of the invention comprises a device for guiding the bolt rope 13 into the entrance of the longitudinal groove 11 of the tubular element 1, as it is hoisted. Guide devices of this kind, or bolt rope guides, are in general formed by two fingers or lips, between which passes the part of the sail close to the bolt rope, this latter being drawn towards the inlet of the groove by fingers or lips. However, these known devices have the disadvantage of weakening the tubular element at the level of its attachment which is generally provided by screws or rivets, and of extending beyond the profile of the tube, so that when the sail is rolled up, it covers the bolt rope guide which causes local deformation of the sail and wear of the cloth. Moreover, the fingers or lips of these bolt rope guides brakes the downward movement of the sail when it is hauled and generate rubbing thereon.

The invention also aims at overcoming these disadvantages. For this, it proposes a bolt rope guide 22 mounted for sliding on the tubular element 1 which is formed by a ring comprising a radial slit parallel to the axis of the tubular element for letting the sail pass therethrough and an inwardly slanting inlet for forming a passage which will lead the bolt rope towards the inlet of the groove as the sail is hoisted. Thus, to hoist the sail, the bolt rope guide of the low part is brought from the low part where it is normally to be found when it is not used, as far as the stop, for example a rivet head fixed in the wall of the tubular element and situated at the level of the inlet of the part of the groove having a narrowed opening, through which introduction of the bolt rope takes place. Of course, the bolt rope guide is orientated so that its radial slit is located at right angles to groove 11. After hoisting the sail, the bolt rope guide is replaced at the bottom of the tube, where the sail is not rolled up.

It can thus be seen that the sliding bolt rope guide does not change the profile of the tubular element in the part where the sail is rolled up and that retraction thereof does away with rubbing on the sail when this latter is hauled down.

Figure 20:
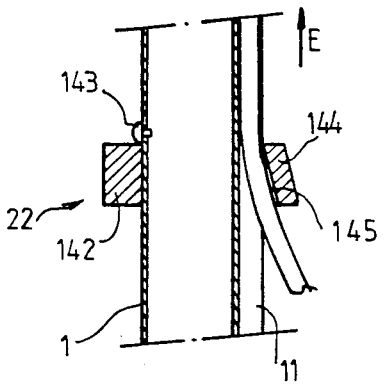
FIGS. 20 and 21 show in axial section (FIG. 20) and in cross section (FIG. 21) a fitted sliding bolt rope guide of the lower part of the tubular element.
Figure 21:
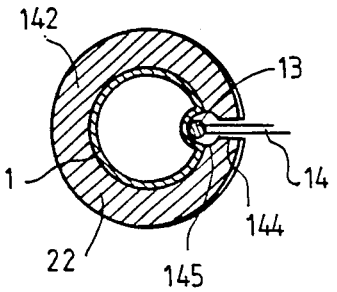

In the example shown in FIGS. 20 and 21, the bolt rope guide 22 consists of a ring 142 sliding on the tubular element 2 until it comes into abutment against the rivet head 143. This ring comprises a radial slit 144 joined to its inner surface by cylindrical surfaces 145 whose axis defines an angle $\alpha$ with the axis of the tubular element 1, so that the bolt-rope 13, fitted into the guide then introduced into the groove 11 of the tubular element 1, is pushed towards the inlet of groove 11 as the sail is hoisted which takes place in the direction of arrow E.

Moreover, according to another feature of the invention, the tack 21 of sail 14 is held in position by a long shackle 20 locked so that it remains substantially parallel to the tubular element 1, by means of a T-shaped part 146 whose bar prevents shackle 20 from moving away from the tubular element 1.

Figure 22:
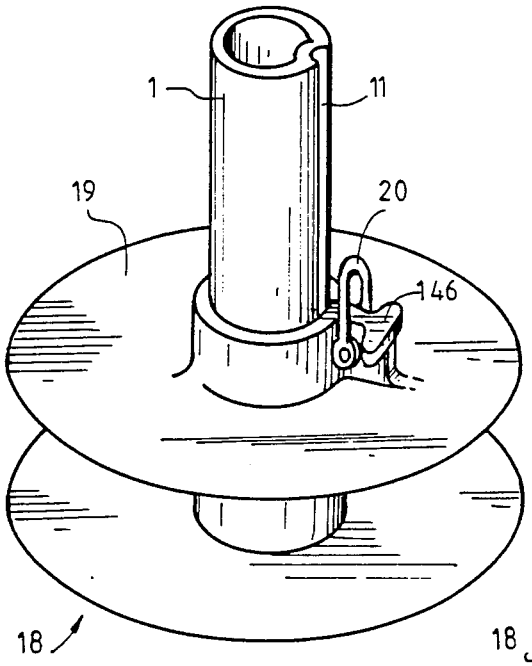
FIGS. 22 and 23 are schematical perspective views of the lower part of the tubular element equipped with a drum, these views illustrating two methods of locking the shackle.

In the example shown in FIG. 22, the T-shaped part 146, which locks the shackle, is molded with the drum 18.

Figure 23:
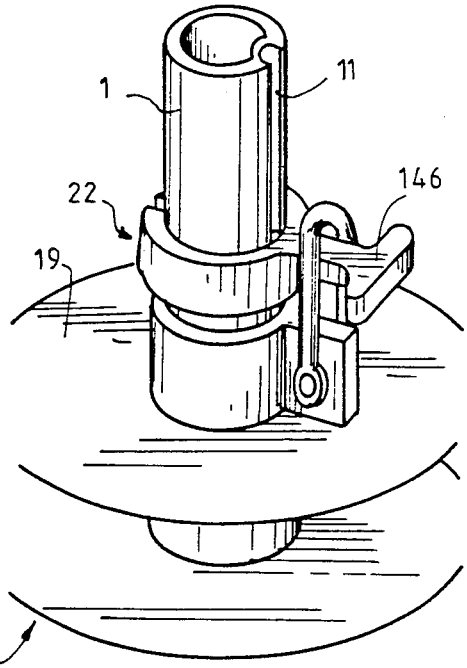

However, an improvement consists in using the previously-described sliding bolt rope guide 22 for locking the shackle. In this case, the T-shaped part 146 forms part of the bolt rope guide 22, as shown in FIG. 23. In this example, the bolt rope guide 22 drawn back to the lower part of the tubular element locks the shackle 20 by its T-shaped portion 146. This device has the advantage of not complicating the low part of the sail shortening device.

As previously mentioned, the invention also aims at avoiding the formation of folds or pockets during reefing up of the sail 14 because of deformations or belly in the sail.

Generally it is known that, so as to reduce the belly of the sail, padding is fixed towards the middle of the tubular element 1 so as to increase the section on which the rolling up takes place. It has also been proposed to dispose a foam web enclosed in the central part of the sail 14. However, these solutions considerably complicate the sail shortening device or the sails and their efficiency only appears when the sail is already reefed up. Thus, for taking up the belly of the sail during reefing up thereof the invention proposes using a tubular element 1 whose groove 11 which receives the bolt rope 13 is not rectilinear, but forms a curve corresponding substantially to that formed by two helixes with variable and reverse pitches, and which join up towards the middle of the tubular element 1. In other words, by developing the surface of the tubular element 1, as shown in FIG. 24, the groove 11 appears substantially in the plane as an arc of a circle with a very large radius.

FIG. 25 shows in perspective the curve followed by the groove 11 on tubular element 1. In this Figure, the angle $\beta$ corresponds to the angular offset of the part of the groove situated towards the middle of the tubular element with respect to the two ends.

FIGS. 26 and 27 illustrate the principle of this method of compensating for the belly of the sail. With sail 14 hanked in groove 11 and placed under tension T and with the tubular element 1 free to rotate, the system will place itself in the position of equilibrium shown in FIG. 26, the references A and A′ designating the ends of groove 11 and reference B the central part. The sail 14 which may be considered as an inextensible surface has its central part BE less stretched than its edges AE and A′E, this position leads to a bellied sail. When the tubular element 1 is subject to rotation R, the part BE is more stretched than AE and A′E, this other position shown in FIG. 27 leads to a flat sail.

This improvement thus presents the advantages of being able to adjust the belly of the sail continuously before rolling up starts and producing reefing up after the belly of sail 14 has been automatically reduced, this greatly improves the quality of the surface of the reduced sail by avoiding the pocket and the folds which form when a bellied sail is reefed up on a tubular element having a rectilinear groove 11.

The invention further comprises the manufacturing process for obtaining on the assembly of the tubular element 1 the particular shape of groove 11. As mentioned above, the tubular element 1 is formed by an assembly of tubular sections 3, 4, 5, 6 connected to each other by existing means and the shape of groove 11 on the assembly of the tubular element 1 is defined by the coupling together of helical grooves 11 formed on the different sections.

In an advantageous embodiment of the invention, the helical grooves 11 result from torsional deformations of the tubular sections 3, 4, 5, 6, obtained by applying a torque between the two ends of the section by means of an appropriate tool, which may be carried out by known industrial means. The value of the torque applied determines the pitch of the helix and the direction of application allows helixes to be formed having right hand and left hand pitches which are indispensable for achieving the desired shape.

It will be noted that in the example shown in FIG. 1, the helical grooves of sections 3 and 4 have reverse pitches to those of sections 5 and 6.

Moreover, for improving the drive applied to sail 14 during rotation of the tubular element and so as to avoid folds or pockets in the sail following axial sliding on the tubular element, this latter may advantageously comprise longitudinal grooves 200 (FIG. 2) which increase the coefficient of friction of the sail on the tubular element 1 in the longitudinal direction.

I claim:

1. A sail shortening device for rolling up a sail with a bolt-rope on a tubular element mounted for rotation about a rigging cable of a sailing boat and having a longitudinal axis and a lower zone, this device comprising:

at least two tubular sections connected end to end through a junction plane for forming said tubular element, connecting means comprising at least one shaped connecting element engaging in said tubular sections, on each side of said junction plane and having an inner surface and two extreme edges extending parallel to said longitudinal axis, two shaped end elements similar to the connecting element and mounted at both ends of the tubular element, bearings, each comprising two semi-cylindrical parts, said bearings being housed respectively between said cable, said shaped connecting element and the two shaped end elements, so as to allow free rotation of the tubular element about the cable, at least one longitudinal groove formed in the tubular element which comprises a longitudinal cavity with a section at least equal to the section of the bolt-rope and an outer longitudianl opening whose width is at least equal to the diameter of the bolt-rope in the lower zone of the tubular element and less than the diameter of the bolt-rope in the remaining part of the tubular element, so as to be able to introduce the bolt-rope into the longitudinal groove through the opening provided in the lower zone, a device for axially holding the tubular element in position comprising an inner tubular sleeve fixedly mounted to the lower part of the tubular element and an outer sleeve, mounted for rotation on the inner tubular sleeve, and fixing means connecting the outer sleeve to a fixed part of the boat, means for rotating said tubular element, coupled to said inner sleeve, a swivel slidably mounted on the tubular element comprising an inner sleeve locked in rotation with the tubular element and comprising means for fixing the sail, an outer sleeve mounted for rotation on the inner sleeve and comprising means for fixing to a halyard for hoisting and tensioning the sail, means for guiding the bolt-rope mounted in the lower zone of the tubular element for facilitating introduction of the bolt-rope inside the longitudinal groove.

2. The device as claimed in claim 1, wherein said tubular sections each comprise a longitudinal boss having two oblique sides, and said shaped connecting element comprises two oblique edges coming respectively into abutment against the two oblique sides of said boss.

3. The device as claimed in claim 2, wherein said tubular sections each comprise further a dovetail-shaped projecting rib diametrically opposite said boss, through which are formed radial tapped bores, said shaped connecting element comprises a longitudinal cavity with dovetail-shaped section in which the rib of the tubular sections is engaged, and clamping screws are screwed into said bores so as to obtain locking with take-up of play of said tubular section on said shaped connecting element.

4. The device as claimed in claim 3, wherein said shaped connecting element comprises, on each side of said longitudinal cavity with dovetail-shaped section, two external reinforcing pieces each comprising a cylindrical surface coming into abutment against an inner cylindrical surface of the tubular sections.

5. The device as claimed in claim 1, wherein said tubular sections each comprise two diametrically opposite longitudinal grooves whose walls form, inside the tubular section, two diametrically opposite bosses each comprising two oblique sides, as well as two diametrically opposite dovetail-shaped longitudinal internal ribs which extend half way along said bosses and are equipped with tapped radial bores, the connecting means comprise two shaped connecting elements substantially semi-cylindrical in shape each comprising two oblique longitudinal edges coming into contact with two corresponding oblique sides of said bosses, and clamping screws are screwed into said bores, so as to obtain locking with take-up of play of said tubular sections on said two shaped connecting elements.

6. The device as claimed in claim 1, wherein the tubular sections each comprise at least one inner projection for limiting the penetration of the connecting means inside the section.

7. The device as claimed in claim 6, wherein said tubular sections each comprise a dovetail-shaped projecting rib and said projection consists of a deformation of said dovetail-shaped projecting rib of the sections.

8. The device as claimed in claim 1, wherein said two semi-cylindrical parts of said bearings are mounted inside said shaped connecting element, each of these two semi-cylindrical parts comprising two ends having two respective flanges abuting against the ends of the connecting means.

9. The device as claimed in claim 1, wherein the inner sleeve of the swivel consists of a machined section of a shaped piece comprising at least one inner projection penetrating into the longitudinal groove of the tubular element and at least one outer radial wing comprising means for fixing the sail, and the outer sleeve of the swivel consists of a machined section of a shaped piece which comprises at least two outer ribs for maintaining the means for fixing the halyard laterally in position.

10. The device as claimed in claim 9, wherein said means for fixing the halyard consist of a punched steel strip fixed by screwing to said outer sleeve between said outer ribs.

11. The device as claimed in claim 1, wherein the inner sleeve of the device for holding the tubular element axially in position consists of a machined section of a shaped piece comprising at least one inner projection penetrating into the longitudinal groove of the tubular element and at least one outer radial wing, and the outer sleeve of the device for holding the tubular element axially in position comprises at least two outer ribs for maintaining laterally in position the fixing means connecting said outer sleeve to a fixed part of the boat.

12. The device as claimed in claim 11, wherein the inner sleeve of the device for holding the tubular element axially in position comprises, beyond the outer sleeve, a cylindrical part having two external radial wings and said rotational drive means comprise a drum having a central bore with two axial grooves, which is engaged on said cylindrical part of the inner sleeve, with interpenetration of the wings of the inner sleeve in said grooves.

13. The device as claimed in claim 12, wherein said drum comprises two flanges with conical outer edges.

14. The device as claimed in claim 13, wherein the flanges of said drum comprise coaxial ribs.

15. The device as claimed in claim 12, wherein said drum comprises means for mounting a shackle and a T-shaped element adapted to lock the shackle so that it remains substantially parallel to the tubular element.

16. The device as claimed in claim 11, comprising at least one assembly formed of two parallel rods firmly secured together and consisting of a bar bent into the shape of a U whose web comprises a structure coming into engagement between said lateral ribs of the outer sleeve of the device for holding the tubular element axially in position and at least one screw for fixing said bar between said ribs by screwing.

17. The device as claimed in claim 11, comprising at least one assembly formed of two parallel rods firmly secured together and consisting of a bar bent into the shape of a U having a web and a slide fixed to said web which is engaged between said lateral ribs.

18. The device as claimed in claim 1, wherein said means for guiding the bolt-rope comprise a ring mounted for sliding on the tubular element and which comprises a radial slit parallel to the axis of the tubular element for letting the sail pass therethrough and an inwardly slanting inlet for forming a passage adapted to lead the bolt rope towards the inlet of the groove as the sail is hoisted.

19. The device as claimed in claim 18, wherein said radial slit is joined to the inner surface of the ring by cylindrical surfaces whose axis defines an angle $\alpha$ with the axis of the tubular element.

20. The device as claimed in claim 18 which comprises a drum for rotating said tubular element, said drum being provided with means for mounting a shackle and wherein said ring used for guiding the bolt-rope comprises a T-shaped element adapted to lock the shackle substantially parallel to the tubular element.

21. The device as claimed in claim 1, wherein said longitudinal groove of the tubular element forms a curve formed by two helixes with variable and reverse pitches, and which join up towards the middle of the tubular element.

22. The device as claimed in claim 1, wherein said tubular element further comprises longitudinal grooves in order to increase the coefficient of friction of the sail in the longitudinal direction.

* * * * *